United States Patent [19]

Miller

[11] Patent Number: 4,549,334

[45] Date of Patent: Oct. 29, 1985

[54] FABRIC MOUNTING TRACK SYSTEM

[76] Inventor: Lloyd Miller, 16842 Greenview La., Huntington Beach, Calif. 92649

[21] Appl. No.: 441,990

[22] Filed: Nov. 16, 1982

[51] Int. Cl.[4] ..... B25B 27/14

[52] U.S. Cl. ..... 29/278; 24/160; 24/456; 24/459; 24/518; 160/398; 160/404

[58] Field of Search ..... 24/150 R, 152, 305, 24/335, 350, 355, 368, 380, 456, 459, 460–462, 489, 517, 518, 160; 52/222, 631, 658; 160/327, 328, 380, 382, 383, 397, 392–395, 402, 404, 398; 29/278

[56] References Cited

U.S. PATENT DOCUMENTS

| | | | |
|---|---|---|---|
| 617,204 | 1/1899 | Thoma | 24/150 R |
| 1,207,850 | 12/1916 | Bried | 160/394 |
| 3,099,058 | 7/1963 | Pettingell | 160/382 X |
| 3,308,598 | 3/1967 | Wilson | 24/152 X |
| 3,822,734 | 7/1974 | Tombu | 160/327 X |
| 3,833,046 | 9/1974 | Tombu | 160/327 |
| 3,848,380 | 11/1974 | Assael | 52/222 |
| 4,053,008 | 10/1977 | Baslow | 160/327 |
| 4,164,105 | 8/1979 | Herbst et al. | 160/397 X |
| 4,197,686 | 4/1980 | Baslow | 160/327 X |
| 4,403,642 | 9/1983 | Morris | 160/328 X |

FOREIGN PATENT DOCUMENTS

| | | | |
|---|---|---|---|
| 196930 | 4/1938 | Switzerland | 160/395 |

*Primary Examiner*—William E. Lyddane
*Assistant Examiner*—James R. Brittain

[57] ABSTRACT

A fabric mounting track system which permits one to mount a fabric to cover a wall without the need to utilize weltings and other devices to cover unsightly parts of the system. The fabric mounting track consists of two parts, a back support plate and a hinge lock plate. The hinge lock plate has a straight portion at one end and a substantially circular portion at the other end forming a hinge. The hinge is disposed in a plane spaced from the straight portion. The back support plate also has a substantially circular portion at one end forming a larger hinge into which the smaller hinge of the hinge lock plate fits. Extending from the straight portion of the back support plate at an acute angle is a ledge, while the other end terminates in a straight portion forming a small angle, and may have its free end extending in the opposite direction. The hinge lock plate is provided with substantially equally spaced lancings punched out from the straight portion of the hinge plate. At intervals between a number of lancings, one of the lancings is larger in size. It will pierce the fabric to support it while the back support plate is hanging down from the hinge lock plate. Thereupon the hinge lock plate is rotated 180° so that the large size lancings will hook behind the ledge, while the small size lancings will impact the free end of the ledge, thereby forcing the fabric through the lancings. The lancings now support the fabric. The mounting track is capable of withstanding a fabric pull of at least ten to twelve pounds per inch and may withstand as much as twenty pounds' pull per inch. Various modifications of the fabric mounting track are also disclosed.

12 Claims, 13 Drawing Figures

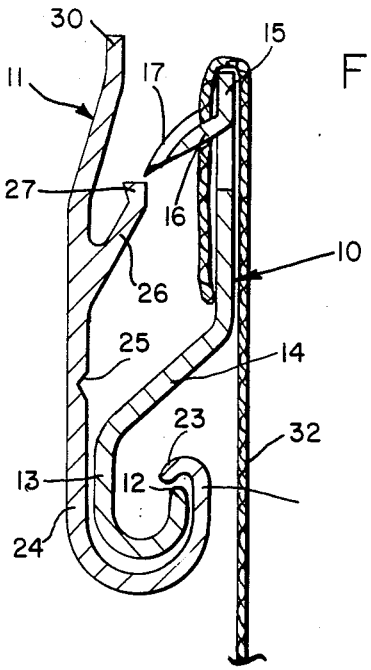
Fig. 6.
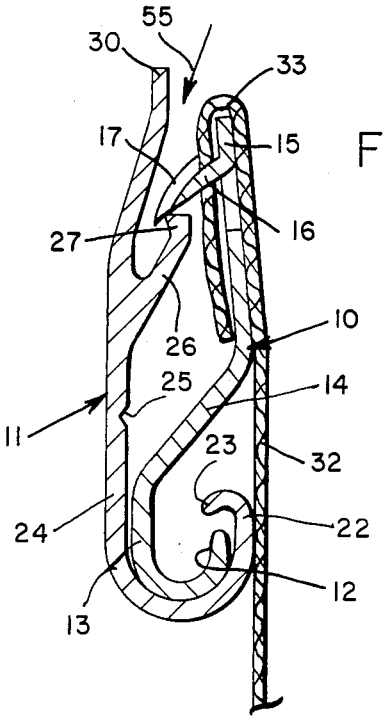
Fig. 7.
Fig. 8.
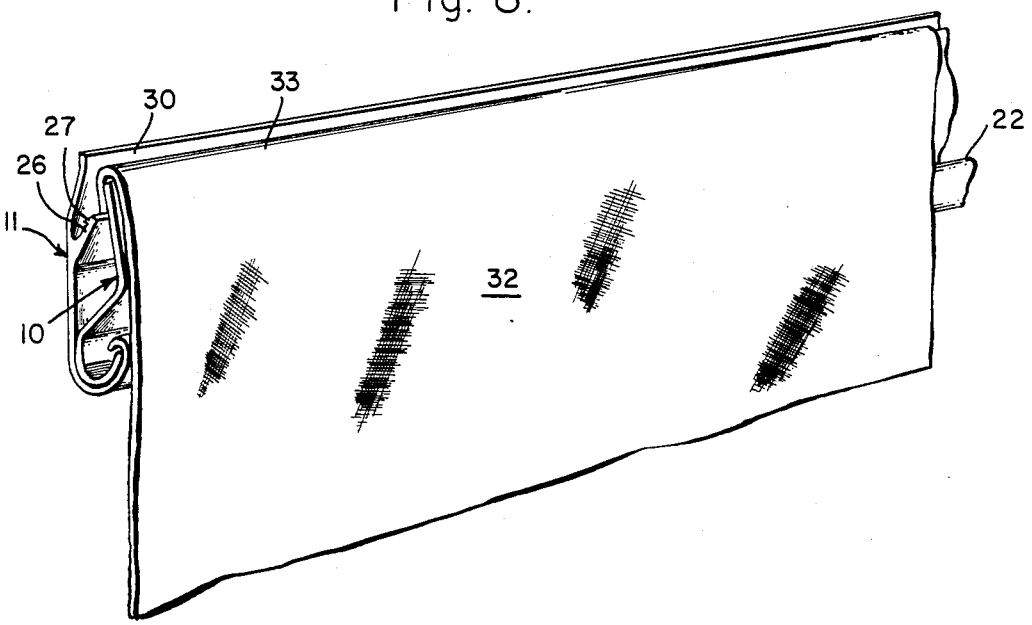

FABRIC MOUNTING TRACK SYSTEM

BACKGROUND OF THE INVENTION

This invention relates generally to a fabric mounting track and particularly relates to such a track by means of which a fabric can be mounted at the top and bottom of a wall or on a ceiling, while the fabric hangs straight and slightly spaced from the wall.

Various systems have been devised in the past for mounting a fabric on a wall. One of the simplest ways of accomplishing this is to provide adhesive on the back of the fabric. The fabric can then be hung like wallpaper. However, the dry wall must be primed to properly accept the adhesive. The adhesive is hydroscopic and hence changes its properties and its thickness with moisture. It is practically impossible to remove the fabric without tearing it, and in addition the removal of the fabric and the adhesive will damage the dry wall.

According to another prior art system, the fabric is simply nailed or stapled to the dry wall, or else to a wooden strip which may be nailed to the studs of the dry wall. In this case, the unsightly top of the structure; that is, the nails or staples, must be hidden by welting. The fabric cannot be removed, cleaned, and replaced, because it tears when it is removed from the staples or nails. Staples are conventionally used, and it is found that the wall may break at the horizontal line of the staples, so that the wall has to be refinished.

Still another system is known as the FABRITRACK system. Here the track consists of a plastic structure including a rectangular box-like portion with an open slit at the top and a flat plate at the back. The top portion of the slit of the box is turned over, either with a straight portion or with a very small acute angular portion. The straight plate is nailed or otherwise secured to a wall and the fabric is forced into the slot of the box by a suitable tool. In addition, the front of the box is provided with an adhesive material. Hence, the fabric is held both by the friction created by the overturned top portion and by the adhesive material of the box.

In the first place, it is rather difficult to insert the fabric into the slit portion of the box. A tool might facilitate this operation. However, it is still difficult to hold the fabric up against the wall in the desired horizontal fashion. Due to the construction of the box, the fabric is spaced a substantial distance from the wall. Furthermore, due to the somewhat weak forces which hold the fabric by friction and adhesion, the fabric may be unevenly mounted on the wall and may form folds or waves instead of being straight, and may either tear or fall from the wall.

Finally, in accordance with still another system, known as the "Stretch-Wall" system, individual panels are mounted on the wall. Each panel has the size of 1'×4'. Such a system is rather expensive and has the disadvantage that in order to fit a wall not of standard length, a few smaller panels may be required, which may have to be specially made.

SUMMARY OF THE INVENTION

The fabric mounting track of the present invention positively holds the fabric, not by friction but by means of a set of lancings punched out from one of the two plates of which the track consists. Thus, the hinge lock plate is provided with a substantially circular section, open at one end, and a straight plate from which the lancings are punched out. The lancings are substantially equally spaced, and periodically a substantially larger lancing is provided, over which the fabric may be pulled and which pierces the fabric. The back support plate has a straight intermediate portion which is nailed to the wall or otherwise secured, for example to the studs in the wall. One of its ends is also provided with a substantially circular hinge portion of substantially larger diameter than that of the hinge lock plate, so that it fits over the hinge of the hinge lock plate.

The back support plate is provided with a ledge forming an acute angle with the straight portion thereof. The large lancings, when the back support plate is rotated through 180°, will hook over the ledge to hold the two plates together. At the same time, the small size lancings will impact the ledge plate and hence force the lancings through the fabric, to hold the fabric positively and without the use of friction.

A modification of the mounting track of the present invention has cuts through the hinge portion of the back support plate and also through the ledge, to facilitate bending the track to accommodate corners, curves, and the like, of a wall. At the same time, the hinge lock plate may be cut into individual sections corresponding to the cuts made through the back support plate, so that the fabric will hang smoothly in a corner or curved area.

Finally, a simplified version of the present invention consists of a single strip of metal having both small size and large size lancings punched therefrom. The strip is mounted to the wall by a strip of adhesive material having adhesive on both surfaces. After the fabric has been pierced by the large lancings, the metal strip is rotated through 180° and the lancings are pressed into the wall.

The novel features that are considered characteristic of this invention are set forth with particularity in the appended claims. The invention itself, however, both as to its organization and method of operation, as well as additional objects and advantages thereof, will best be understood from the following description, when read in connection with the accompanying drawings.

BRIEF DESCRIPTION OF THE DRAWINGS

FIG. 6 is a cross-sectional view of the track mounting system of the invention, with a piece of fabric hanging therefrom and before the hinge lock plate is finally locked into place;

FIG. 7 is a cross-sectional view similar to that of FIG. 6, with the hinge lock plate locked into place and the small size lancings piercing the fabric;

FIG. 8 is an elevational view similar to FIG. 1 but showing the fabric in place and hanging from the track mounting system;

DESCRIPTION OF THE PREFERRED EMBODIMENTS

Figure 1:
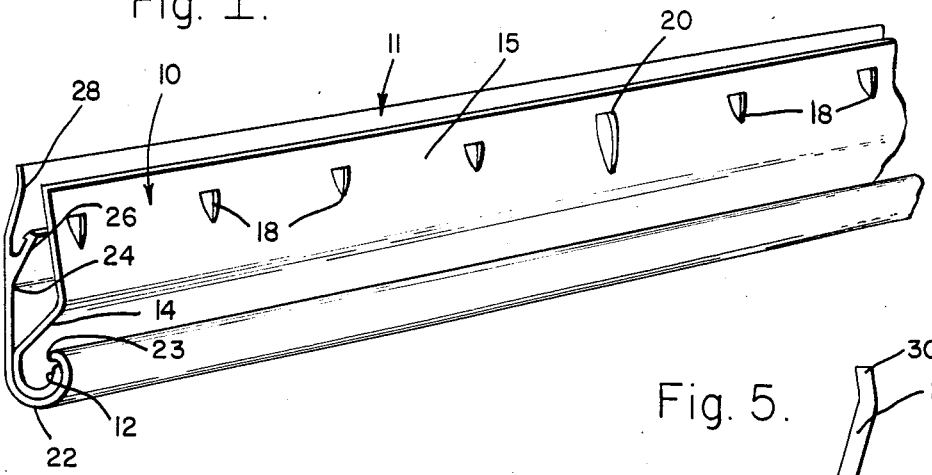
FIG. 1 is a view in perspective of the preferred embodiment of the fabric mounting track of the present invention.

Referring now to the drawings, and particularly to FIGS. 1 through 5, there is illustrated a preferred embodiment of the present invention. As shown particularly in FIGS. 1 through 4, the fabric mounting track of the invention consists of two separate pieces; that is, a hinge lock plate 10 and a back support plate 11. The hinge lock plate 10 is provided at one of its ends with a substantially circular portion 12, which of course is open at one end, as shown. It is connected by a straight intermediate portion 13 to another straight portion 14 which forms an abtuse angle with the end portion 15.

Punched from the end portion 15 of the hinge lock plate 10 are small size and large size lancings, respectively 16 and 17. These lancings are punched out from the straight end portion 15, as shown clearly in FIG. 1 at 18 for the small lancings and at 20 for the large lancings.

The back support plate 11 again has a hinge portion 22 at one of its ends, terminating in an outermost portion 23 of still smaller radius. It continues with a straight intermediate portion 24, which may be notched or scored at 25 to provide a mark for nailing or mounting the back support plate to a wall.

The straight portion 24 includes a ledge 26 which forms an acute angle with the straight intermediate portion 24. It has a rearwardly extending projection or nose 27, as shown particularly in FIG. 4, to provide a positive support for the large lancings 17. The other free end of the back support plate includes another straight portion 28, forming a smaller acute angle with the straight intermediate portion 24 and terminating at its outermost end in a backwardly extending portion 30, to facilitate unlocking of the fabric mounting track when required after closing.

Figure 5:
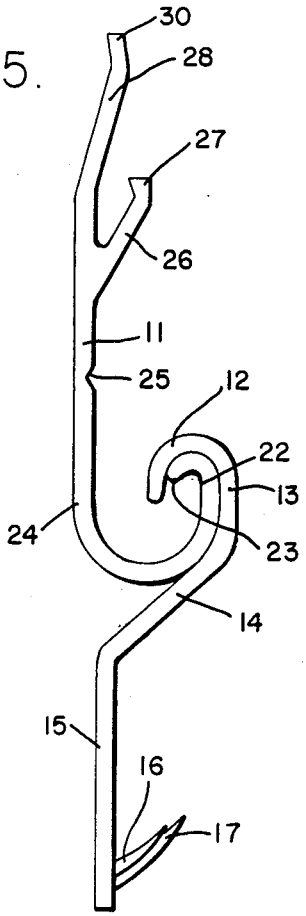
FIG. 5 is a side elevational view of the hinge lock and back support plates, hinged together in the position for initially mounting the fabric thereon.
Figure 4:
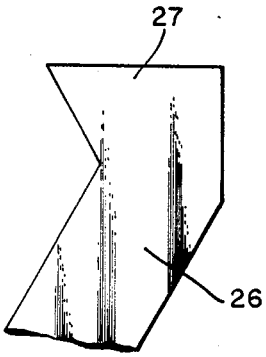
FIG. 4 is a side elevational view on still more enlarged scale of the end portion of the ledge of the back support plate.

The manner of mounting a piece of fabric on the fabric mounting track of the invention will now be explained, by means of FIGS. 5 through 7. Initially, the fabric is mounted by piercing it by the large lancings 17, in the position of FIG. 5. Subsequently, the hinge lock plate 10 is rotated through almost 180° to the position of FIG. 6. Now the fabric 32 will hang over the free edge of the straight portion 15 of hinge lock plate 10. The large lancing 17 is about to engage the ledge 26 of the back support plate 11. When the hinge lock plate 10 is pressed toward the back support plate 11, the structure illustrated in FIG. 7 is obtained. Here the large lancings 17 hook over the projection or nose 27 of the ledge 26, while the small lancings 16 subsequently impact the ledge 26 to pierce the fabric 32. The fabric will subsequently cover the outermost edge portion 30 of the back support plate 11.

It will now be evident that the fabric is positively retained by the respective lancings 16 and 17 and is now capable of withstanding a pull of ten to twelve pounds per inch, which is necessary to obtain a good stretch of the fabric. Actually, up to 20 pounds' pull per inch may be exerted against the mounting track of the invention, to provide a fabric which smoothly covers the wall and which can be pushed against the wall without disturbing its smooth appearance.

Preferably, the fabric is backed by a polyester fiberfill batting, obtainable, for example, from Rohm and Haas in Philadelphia, PA. Other types of batting may also be used. Such a batting provides a vapor barrier inside the room to furnish superior insulation and substantially reduce heat loss. Other suitable insulation would be polyester or fiberglass which may have an acrylic latex coating. These materials are flameproof. They actually provide better insulation than pure goose down, because goose down is hydroscopic and when wet is outperformed by polyester fiberfill, which does not lose its loft and insulating value.

Hence, it will be seen that by using batting of the type described, the upper edge 33 of the fabric will cover the outer edge 30 of the back support plate.

The finished product is illustrated in FIG. 8. The mounting track may be opened again, with a suitable tool which is inserted between the tops of the two plates 10 and 11.

Since some of the dimensions are rather critical, by way of example the dimensions of a suitable track are given herein. The hinge lock plate has a total length of 1.585". The radius of curvature of the hings portion 12 is 0.172". The straight portion 13 has a length of about 0.2". The straight intermediate portion 14 has a projected length of 0.490" and the straight end portion 15 has a length of 0.873". The straight portion 14 makes an acute angle of 40° with a vertical through the straight portion 15. Accordingly, the hinge portion 12 is spaced from a plane passing through the end portion 15.

Concerning the back support plate 11, the hinge portion 22 has a radius of 0.188" and the outermost end 23 has a radius of 0.100". The notch 25 is spaced from the curved portion 22 by 0.669". The ledge 26 makes an acute angle of 30° with the straight portion 24. The straight portion 28 makes an obtuse angle of 15° with the straight portion 24, while the outermost end 30 make an obtuse angle of 10° with a line parallel to the straight portion 24.

The length of the small size lancings 16 is about $\frac{3}{8}$ inch, while that of the large size lancings 17 is $\frac{1}{2}$ inch.

The lancings are spaced apart at out one inch center to center, and are made by a triangular punch forced through the straight portion 15. When the small lancings hit the ledge 26, the fabric is pierced by shear action and the two plates have a pressure fit, because the large lancings 17 hook over the ledge portion 27.

If the fabric should be substantially thinner than the normal fabric, it may be useful to back up the fabric with a suitable adhesive, which in this case does not serve the purpose to mount the fabric to the wall but only to stiffen the fabric for easier mounting.

The mounting track of the invention may be used for mounting the fabric top and bottom on a vertical wall. Similarly, it may be used to mount a fabric on the ceiling. Where two mounting tracks meet each other at a corner of 90°, the back support plate may be cut near the corners so that both sets of mounting tracks can be accommodated.

Figure 9:
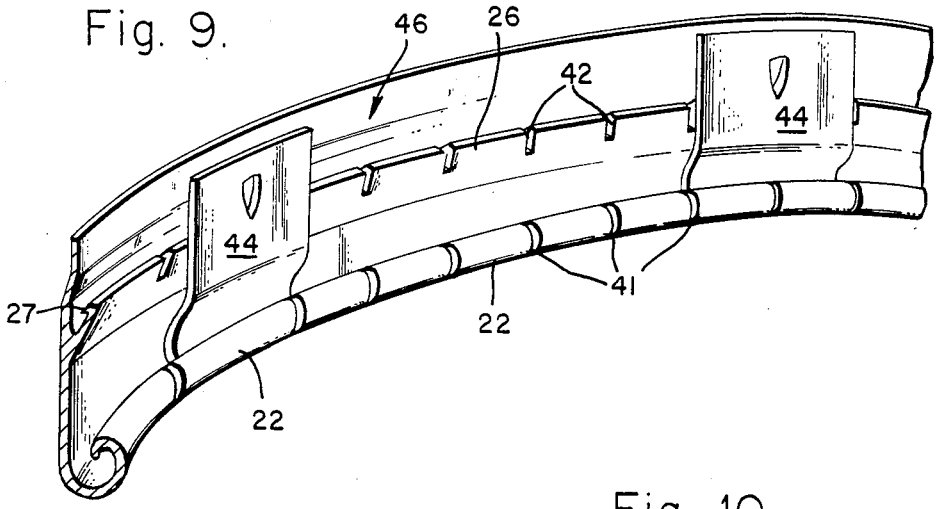
FIG. 9 is a view in perspective similar to that of FIG. 1 but illustrating a modification where the back support plate is cut through its hinge portion and ledge portion to facilitate bending thereof, as well as a few hinge lock plates, each being of a size to cover the space between two adjacent cuts.

In some cases the wall may not be straight, but may be curved. In such a case, the fabric mounting track of the invention may still be used, by treating it as shown in FIG. 9, modified for curfing.

Here the back support plate 40 is provided with cuts 41 through the hinge portion 22, the cuts being spaced a suitable distance apart, commensurate with the amount of bending to be accomplished. Similarly, the ledge 26 should be cut as shown at 42, each of the cuts 42 being in the same plane as that of the cuts 41. These cuts permit bending of the back support plate to the desired degree. At the same time the hinge lock plate 44 may be cut into suitable pieces, each of which will extend to one of the cuts 41. Otherwise, the fabric is secured as previously described. Nevertheless, the mounting track retains its full structural strength.

Figure 10:
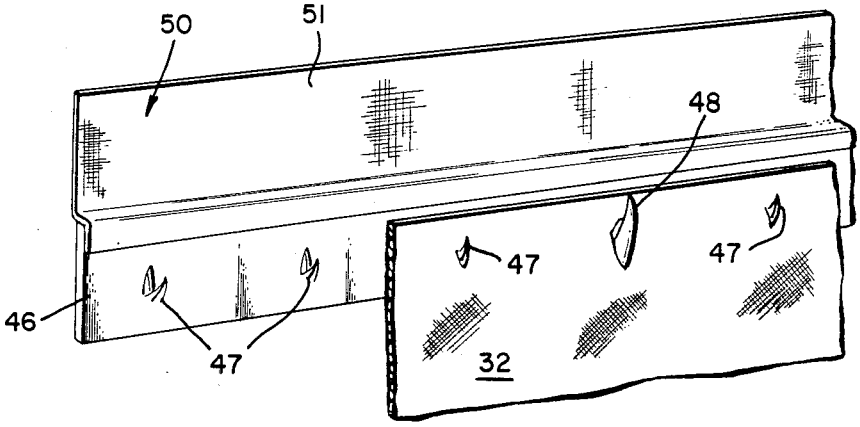
FIG. 10 is a view in perspective of a single flat plate provided with lancings and supported by an adhesive strip on a wall, or the like, with a portion of fabric pierced by small and large size lancings.
Figure 11:
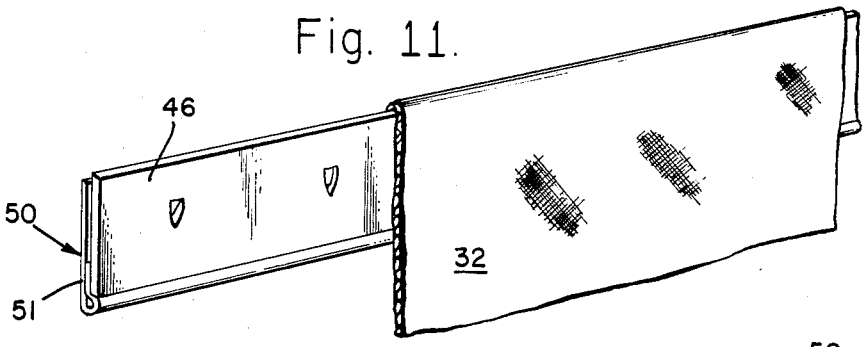
FIG. 11 is a view in perspective, similar to that of FIG. 10 and showing the fabric in place after the plate carrying the lancings has been rotated through 180°.
Figure 12:
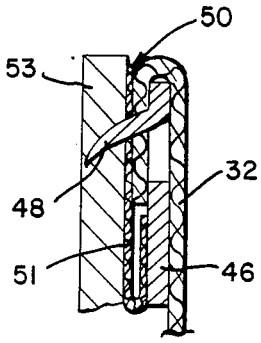
FIG. 12 is a cross-sectional view of a portion of the track mounting system of FIG. 11 on enlarged scale to show a large lancing piercing the fabric and wall.

Finally, a much simplified and less expensive fabric mounting track is illustrated in FIGS. 10 to 12. Here the mounting track consists of a single piece; that is, a flat metal strip 46. In this modification the fabric need not be provided with batting. Also, there is no need to prepare the wall, and even a rough wall may be used, thus constituting a true dry hang system without using any adhesive. The metal strip 46 is again provided with lancings, shown at 47 and 48. The metal strip 46 is secured to a double-faced adhesive tape 50, of which the free end 51 may be stuck to the wall. The fabric 32 may then be secured to the lancings 47 and 48 by simply piercing the fabric with the lancings, as shown in FIG. 10. The metal strip 46 is then rotated through 180° with the tape 50 serving as a hinge, whereupon the lancings 47 and 48 will pierce the wall 53.

Also, a double-faced reinforced adhesive tape is used over the length of the lancings against which the fabric is pressed, to insure that the fabric hangs straight. Such a tape will resist a pull in shear. It is feasible to provide the adhesive tape 50 with a covering strip which extends beyond the metal plate 46 when it is in the position of FIG. 11. This tape serves for the easy removal of the metal plate 46 and the fabric thereon.

Figure 2:
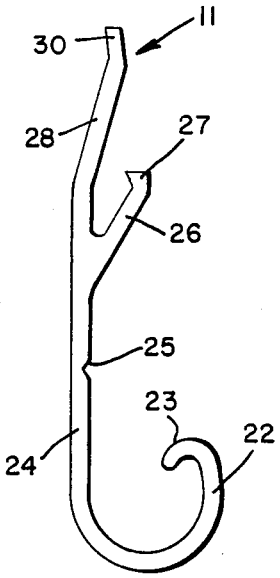
FIG. 2 is a side elevational view on enlarged scale of the hinge lock plate.
Figure 3:
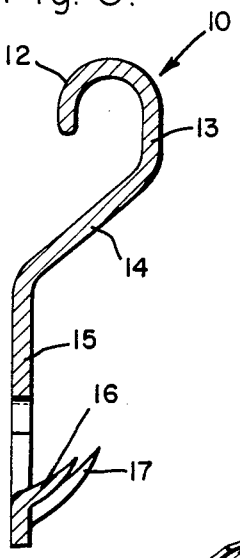
FIG. 3 is a side elevational view on enlarged scale of the back support plate.

Preferably, the hinge lock plate 10 and the back support plate 11 consist of aluminum, which may be extruded directly into the form shown in FIGS. 2 and 3, but without lancings. The metal plate 46 of FIGS. 10 to 12 may consist of a thin steel sheet, to reduce its weight; besides, the plate 46 need not be extruded.

Figure 13:
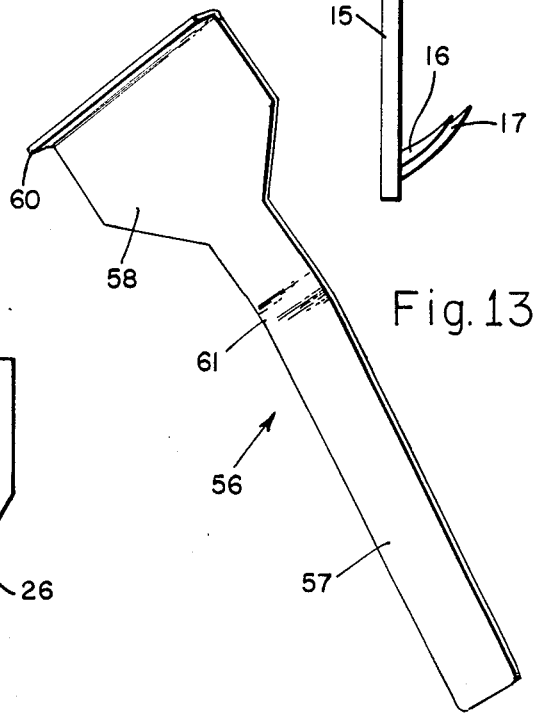
FIG. 13 is a view in perspective of an unlocking tool specially designed for opening the fabric mounting track system of the invention as illustrated in FIGS. 1 through 8 and 9.

Referring now to FIG. 13, there is illustrated an unlocking tool for opening particularly the fabric mounting track of the invention. It is specially designed for the embodiment of the invention illustrated in FIGS. 1 through 8, as well as the modification of FIG. 9.

As shown in FIG. 13, the unlocking tool 56 includes a handle 57 and an enlarged front portion 58 which terminates in a protrusion or lip 60 substantially normal to the plane of the elongated front portion 58.

The tool is, for example, inserted with its lips 60 into the space 55 between the upper end portion 30 of the hinge lock plate and the upper end portion 15 of the back support plate, this space being designated 55 in FIG. 7. Thus, the lip 60 is inserted into this space 55 and thereupon the handle is rotated through a plane substantially normal to that of the unlocking tool. This action will cause the two plates 11 and 12 to unlock.

In carrying out this operation it is essential that the tool does not engage or mar the ceiling. To this end, the tool may be bent by hand as showr at 61, to an extent commensurate with the job at hand; that is, from the distance between the mounting track and the ceiling.

Preferably the unlocking tool 56 is of unitary construction and consists of sheet metal which is capable of being bent to avoid hitting the ceiling of the room to be covered with the fabric. By way of example, a tool which has been found to be suitable for the unlocking operation has a total length of 6.5", the handle having a length of 5" and a width of $\frac{5}{8}$". The width of the front portion 58 may be $1\frac{7}{8}$" and the length of the lip 60 may be 3/16". The thickness of the sheet metal may be 1/16".

There has thus been disclosed a fabric mounting track system which permits to hold the fabric positively by hanging the fabric on lancings punched out from one of the plates of the track. Since the track plates are of metal, they will withstand a substantial pull of fabric when the fabric is pulled straight.

The hinge lock plate may be cut periodically through the hinge portion and the ledge thereof to permit curfing, to accommodate portions of the wall which may not be flat. In that case the hinge back plate may also be cut into portions that will fit between the cuts of the back support plate.

Further, a simplified version of the fabric mounting track is shown, which consists of a single piece of metal provided with lancings of different sizes. The system of the present invention is characterized by its reliability and by the feature of allowing removal of the fabric for cleaning and replacing or exchanging. In addition, with the system of the present invention, the fabric may be installed at a price which is approximately one-tenth that of the other systems on the market.

Finally, an unlocking tool has been disclosed to facilitate unlocking of the locked mounting track.

What is claimed is:

1. In combination with a fabric mounting track for mounting a fabric on a wall of the t:ype including:

(a) a hinge lock plate;

(b) a back support plate;

(c) said plates having means on one end for pivoting them through 180°;

(d) said hinge lock plate having a row of large and small lancings;

(e) said back support plate having ledge means protruding therefrom so that said small lancings impact said ledge means while said large lancings hook behind said ledge means when said plates face each other, thereby to lock said plates; and (f) an unlocking tool for unlocking said locked and facing plates, said unlocking tool consisting of an elongated handle and an enlarged front portion having a small protrusion extending at substantially 90° from said front portion along the front end thereof, said tool being of unitary construction, whereby said tool is capable of being inserted into the ends between said plates and rotated with respect to the planes of said plates to pry said plates apart, while said handle is being bent to avoid hitting the ceiling of the room to be covered with fabric.

2. A fabric mounting track for covering a wall with a fabric, comprising:

(a) a back support plate; and (b) a hinge lock plate;

said back support plate consisting of an elongated single sheet of metal having a first intermediate straight portion, a substantially arcuate segment of said back support plate having an inwardly bent free end, said end portion and free end forming a hinge for said hinge lock plate, a straight ledge portion extending from said intermediate portion and forming an acute angle with said intermediate portion and extending away from said hinge;

said back support plate having its other free end bent upwards in the same direction as said ledge portion but at a smaller acute angle than that of said ledge portion with respect to a vertical parallel to said first intermediate straight portion;

said hinge lock plate consisting of an elongated single sheet of metal having a substantially straight hinge lock portion along one end;

a second intermediate straight portion bent at an acute angle with respect to a vertical through said first intermediate straight portion; and a third intermediate short straight portion substantially parallel to a straight end portion and being followed by an arcuate segment having a radius of curvature smaller than that of said arcuate segment of said back support plate;

said circular outermost portion being spaced from a plane passing through said straight portion along one end, whereby said hinge lock and back support plates fit partially into each other to form a hinge rotatable through 180°.

3. A fabric mounting track as defined in claim 2 wherein small size lancings having sharp tips thereon are provided substantially equally spaced along said straight hinge lock portion of said hinge plate, said lancings being punched out with their tips facing and substantially touching said ledge portion of said back support plate when said hinge plate faces said back support plate.

4. A fabric mounting track as defined in claim 3 wherein larger sized lancings are periodically provided among said small sized lancings, said larger size lancings being of a size to hook behind said ledge portion when said two plates face each other.

5. A fabric mounting track as defined in claim 4 wherein said ledge plate has a rearwardly extending portion for retaining said large size lancings.

6. A fabric mounting track as defined in claim 2 wherein said back support plate has its outermost end bent in the opposite direction from said ledge portion and forming a still smaller acute angle than that said ledge portion.

7. A fabric mounting track as defined in claim 2 wherein said intermediate portion of said back support plate is scored about midway along its length for facilitating securing it to a wall.

8. A fabric mounting track as defined in claim 7 wherein said back supporting plate is secured to a dry wall by fastening means disposed along said scored line to secure a fabric to a dry wall slightly spaced therefrom.

9. A fabric mounting track as defined in claim 2 wherein said back support plate is provided with cuttings extending continuously and substantially vertically, substantially through its arcuate end portion and through its ledge portion, said cuttings being spaced apart in accordance with the desired amount of bending of said back support plate, and said hinge lock plate being cut into vertical pieces corresponding in size approximately to the distance between said cuttings.

10. A fabric mounting track as defined in claim 2 wherein both of said plates are extruded from a metal.

11. A fabric mounting track as defined in claim 10 wherein said metal is aluminum.

12. A fabric mounting track for mounting a fabric on a wall comprising:

(a) a hinge lock plate; and (b) a back support plate;

(c) each of said plates having hinge means at one end for causing said plates to be joined and for allowing them to pivot about each other through an angle of about 180°;

(d) said back support plate being capable of being secured to a wall;

(e) said hinge lock plate having a row of small size lancings protruding therefrom with sharp tips and being substantially equally spaced and having larger size lancings for holding the fabric preparatory to mounting same; and (f) said back support plate having ledge means protruding therefrom, so spaced and arranged that said large size lancings hook behind said ledge means, said small size lancings being arranged to impact on said ledge means to pierce the fabric when said plates are pivoted to be face to face.

* * * * *